US007239713B2

(12) United States Patent
Niederdränk

(10) Patent No.: US 7,239,713 B2
(45) Date of Patent: Jul. 3, 2007

(54) WIRELESS TRANSMISSION SYSTEM FOR HEARING DEVICES

(75) Inventor: Torsten Niederdränk, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 265 days.

(21) Appl. No.: 10/675,664

(22) Filed: Sep. 30, 2003

(65) Prior Publication Data

US 2004/0131213 A1 Jul. 8, 2004

(30) Foreign Application Priority Data

Sep. 30, 2002 (DE) ..... 102 45 555

(51) Int. Cl.
*H04R 25/00* (2006.01)

(52) U.S. Cl. ..... 381/317; 381/315

(58) Field of Classification Search ..... 381/23.1, 381/71.6, 71.7, 312, 313, 314, 315, 316, 381/320, 321; 704/222, 223, 227; 702/57; 455/264, 82, 83, 3.06, 107; 375/219, 220
See application file for complete search history.

(56) References Cited

U.S. PATENT DOCUMENTS 4,419,995 A 12/1983 Hochmair
4,654,880 A * 3/1987 Sontag ..... 455/41.2
5,279,292 A 1/1994 Baumann
5,721,783 A * 2/1998 Anderson ..... 381/328
5,732,390 A * 3/1998 Katayanagi et al. ..... 704/227
5,768,690 A * 6/1998 Yamada et al. ..... 455/83
6,081,702 A * 6/2000 Serfaty et al. ..... 455/264
6,862,436 B2 * 3/2005 Hayakawa et al. ..... 455/82

FOREIGN PATENT DOCUMENTS

| | | |
|---|---|---|
| AT | 21 620 | 11/1986 |
| DE | 41 04 359 A1 | 8/1992 |
| EP | 3527 112 C2 | 7/1988 |
| JP | 2000183782 A * | 6/2000 |

* cited by examiner

*Primary Examiner*—Sinh Tran
*Assistant Examiner*—Brian Ensey
(74) *Attorney, Agent, or Firm*—Schiff Hardin LLP

(57) ABSTRACT

A transmission system for rearing devices is provided that, in spite of having less energy available, allows for a transmission relatively safe from interference. Such a gearing device has a self-exciting oscillation circuit as an antenna that enables an inductive coupling in the long-wave range. Additionally, or alternatively, a hearing device is provided with a receiving device that comprises a median filter device with which a median value can be determined from a plurality of values for noise signal prevention.

18 Claims, 1 Drawing Sheet

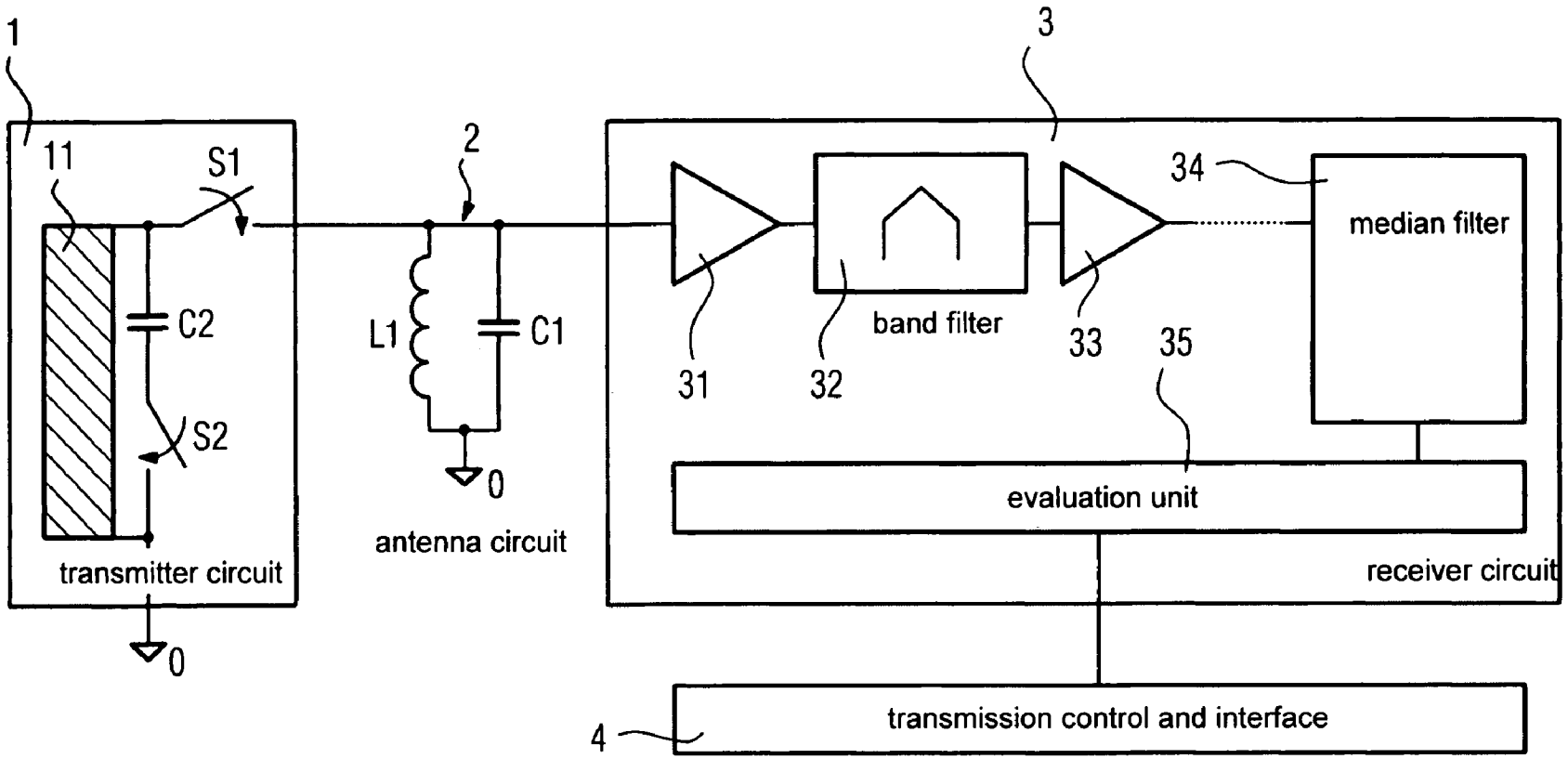
FIG

WIRELESS TRANSMISSION SYSTEM FOR HEARING DEVICES

BACKGROUND OF THE INVENTION

The present invention concerns a hearing device with a radio device to transmit signals, in particular to a second hearing device, whereby the radio device comprises an antenna device to send and/or receive. Furthermore, the present invention concerns a hearing device in which actions are implemented to decrease interfering signals, as well as a corresponding method to decrease interfering signals in hearing device receiving signals of the wireless transmission system.

In hearing device technology, the bidirectional, wireless coupling of hearing devices in binaural supply (i.e., providing each ear with respectively one hearing device) is a goal sought by many audiologists. Due to the spatial and energy limitations, however, the use of the previously known wireless transmission systems is impossible under real conditions. In particular, the realization of the function of the transmission from the hearing device could not previously be realized with maintainable energy use. In connection with this, hearing devices are known that possess a binaural coupling based on a wireless transmission link, whereby, however, unidirectional FM transmission systems with audio-bandwidth (CROS/BiCROS systems) and high energy expenditure are used. Such solutions are not viable, in particular for ITE (in-the-ear) hearing devices.

SUMMARY OF THE INVENTION

The object of the present invention is thus to make available a wireless coupling of hearing devices with efficient energy use.

This object is inventively achieved by a hearing device with a radio device to transmit signals, in particular to a second hearing device, whereby the radio device comprises an antenna device to transmit and/or receive, and whereby the antenna device comprises a self-exciting oscillation circuit.

Furthermore, a hearing device is inventively provided with a receiving device to receive a plurality of values of at least one radio signal, whereby the receiving device comprises a median filter device with which a median value of the plurality of values can be determined for reducing interference signals.

Finally, the object cited above is also achieved according to the present invention via a method to reduce noise signals in a hearing device receiving signals by receiving a plurality of values of at least one radio signal via a hearing device, and median filters of the plurality of values to acquire a median value for a noise signal reduction within the received radio signal.

Preferred embodiments of the invention are based in assembling a transmission link via which control data can be transmitted with a lower rate. This can be preferably realized via a half-duplex transmission link. Due to the effectiveness, the long-wave range should be used for the transmission. This is preferably realized via an inductive coupling with the respective other hearing device.

The use of a quartz oscillator for a frequency reference for data transmission is not possible in hearing devices for spatial reasons. Therefore, in the embodiments, the subsequently specified antenna oscillator is preferably consulted transmission-side as frequency-normal for the transmission system. In addition to establishing the transmission carrier frequency of the antenna oscillator, a bit timing (bitclock) can be derived for the transmitted data stream by subdividing the carrier frequency. An LC oscillator comprising a coil and a capacitance is preferably used as a transmission antenna that possesses a high quality, for example Q>10. This LC oscillator ensures a high efficiency. This can, for example, in the case of transmission, be excited with low power and thereupon oscillates. The high reactive currents thereby ensuing provide for a good radiation of the coil (leakage inductance). For data transmission, this self-excited oscillation circuit can be detuned with regard to its resonance frequency, and thereby be used for frequency modulation.

On the receiving-side, a median filter device can be used for interference signal reduction after narrow-band filtering and digitalization. A median value is acquired with the median filter from a plurality of values that have a relatively small noise portion.

Due to the energy management, an embodiment provides for the communication via a half-duplex transmission line. A narrow-band signal transmission in the long-wave range results in a further energy advantage. As a rule, high bandwidths, as are necessary for the transmission of audio data, can be foregone here.

In the hearing device, the LC oscillation circuit can be used both for the generation of a carrier frequency to transmit and to clock the receiving device, in particular a filter device comprised therein. It is possible with this to form a quartz-independent transmission system. The data rate is thereby determined from the carrier frequency and a predetermined divider. The receiving device preferably first synchronizes to the carrier frequency, and the filtering, for example, width of the median filter, adaptively adjusts to the carrier frequency or, respectively, data rate, such that a suitable evaluation can ensue.

DESCRIPTION OF THE DRAWING

The present invention is now more closely explained using the attached drawing that schematically reproduces a transmitting part and a receiving part of an inventive hearing device. However, the subsequently specified embodiment thereby represents only one preferred embodiment of the present invention.

DETAILED DESCRIPTION OF THE PREFERRED EMBODIMENTS

According to the schematic depiction in the Figure, the radio device of the inventive hearing device comprises a transmitter circuit 1, an antenna circuit 2, and a receiver circuit 3. A data processing unit configured as a transmission control and interface 4 is connected to the receiver circuit 3. The transmitter circuit 1 comprises an amplifier 11 that is connected via a switch S1 to the antenna circuit 2. To transmit, the switch S1 is closed and excites the antenna circuit 2 (that comprises a parallel circuit of a coil L1 and a capacitor C1) with resonance frequency via corresponding feedback with the amplifier 11.

A series connection made of a capacitor C2 and a switch S2 is connected in parallel to the amplifier 11. In the case that the capacitor C2 is hooked up to the capacitor C1, the resonance capacitance rises, whereby the resonance frequency is lowered. The resonance frequency can thus be varied with the aid of the switch S2.

The coil L1 in the antenna resonance circuit 2 enables a good radiation in the long-wave range. In the case that the switch S2 is now switched in time to the transmitted data, a corresponding frequency-modulated data signal is wirelessly radiated by the coil L1.

A compact oscillation circuit can be realized in a very small overall space via the use of the LC antenna circuit 2. Moreover, the oscillation circuit 2 can be operated with relatively low power, since it needs to be activated only briefly by the amplifier 11. Only the energy that is lost via the radiation of the coil L1 needs to be supplied.

The receiver circuit 3 is likewise connected to the antenna circuit 2. If the antenna circuit 2 functions as a receiver, the signal in a receiver circuit 3 is first preamplified in a preamplifier 31 and subsequently supplied to a bandpass filter 32. Freed of unnoticeable frequency portions, the signal is further amplified in an amplification 33, and, if necessary, further processed and supplied to a median filter 34. This median filter 34 filters the average from, for example, five values and therewith provides a very good suppression or, respectively, reduction of noises. The output of the median filters 34 is connected with an evaluation unit 35. From the output of the evaluation unit 35, the receiver signal exits the receiver circuit 3 and is transmitted to a device for further processing that, for example, provides transmission control or presents an interface.

The resonance frequency of the antenna oscillator as a carrier frequency and also a corresponding bit timing is transmitted with the antenna oscillator 2 connected between the transmission part 1 and the receiving part 3. The receiving part 3 connected with a high resistance to the antenna circuit 2 is always active and, in addition to the bit timing, also derives from the receiver signal the information transmitted via frequency modulation.

The receiving part or, respectively, the receiver circuit 3 is therefore able to ensure for hearing devices a narrow-band information transmission from the low-energy inductively transmitted signal, with a suitable reduction of noise signals.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The particular implementations shown and described herein are illustrative examples of the invention and are not intended to otherwise limit the scope of the invention in any way. For the sake of brevity, conventional electronics, control systems and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

REFERENCE LIST

1 transmission circuit
2 antenna circuit
3 receiver circuit
4 data processing unit
11, 33 amplifier
31 preamplifier
32 bandpass filter
34 median filter
35 evaluation unit
C1,C2 capacitors
L1 coil
S1,S2 switches

What is claimed is:

1. A hearing device, comprising:

a radio device to transmit signals to a second hearing device, the radio device comprising:

an antenna device for transmitting, the antenna device comprising a self-exciting oscillation circuit, including a coil and a first capacitor;

the radio device further comprising:

a first switch; and an amplifier and a series connection of a second capacitor and a second switch being connectable in parallel to the first capacitor by the first switch, so that the antenna circuit is excited by the amplifier when the first switch is in its conductive state and a resonance frequency of the self-exciting oscillation circuit can be modulated by switching the second switch while the first switch is in its conductive state.

2. The hearing device according to claim 1, wherein the antenna device consists exclusively of an LC oscillation circuit.

3. The hearing device according to claim 1 further comprising a receiving device comprising a median filter device configured to reduce noise signals.

4. The hearing device according to claim 1, wherein a half-duplex transmission line is established with the radio device.

5. The hearing device according to claim 1, wherein a signal transmission is implemented in the long-wave range with the radio device.

6. A hearing device, comprising:

a receiving device configured to receive a plurality of values representing frequencies of at least one radio signal, the receiving device comprising a median filter device with which a median value of the plurality of values representing frequencies is determined for noise signal prevention; and an antenna device with a self-exciting LC oscillation circuit, wherein the LC oscillation circuit generates a carrier frequency for transmission and clocks the median filtering by the median filter.

7. The hearing device according to claim 6, wherein the antenna device consists exclusively of the LC oscillation circuit.

8. The hearing device according to claim 6, further comprising a transmitter device configured to permit a half-duplex transmission line to be established with the receiving device and the transmitter device.

9. The hearing device according to claim 6, wherein the receiving device is configured to receive in the long-wave range.

10. The hearing device according to claim 6, wherein each of the plurality of values is a measure for a period duration of the self-exciting oscillation circuit.

11. The hearing device according to claim 1, further comprising:

a receiving device;

wherein the self-exciting oscillation circuit is an LC oscillation circuit that is configured both to generate a carrier frequency for transmission and to clock the receiving device.

12. The hearing aid device according to claim 11, wherein the LC oscillation circuit is used to clock a filter device of the receiving device.

13. A hearing device, comprising:

a radio device to transmit signals to a second hearing device, the radio device comprising an antenna device to perform at least one of transmitting and receiving, the antenna device comprising a self-exciting oscillation circuit; and a receiving device configured to receive a plurality of values of at least one radio signal, the receiving device comprising a median filter device with which a median value of the plurality of values is determined for noise signal prevention;

wherein the antenna device a self-exciting oscillation circuit comprises an LC oscillation circuit and the LC oscillation circuit is used both to generate a carrier frequency for transmission and to clock the receiving device.

14. The hearing aid device according to claim 13, wherein the LC oscillation circuit is used to clock a filter device of the receiving device.

15. A method for noise signal reduction in hearing device receiving signals, comprising:

transmitting signals by a radio device of a first hearing device to a second hearing device;

performing, by an antenna device, which comprises a self-exciting oscillation circuit, of a radio device of the first hearing devices, the transmitting;

receiving a plurality of values representing frequencies of at least one radio signal via the first hearing device;

median filtering of the plurality of values representing frequencies to produce a median value for a noise signal reduction; and providing an LC oscillation circuit that both generates a carrier frequency for transmission and clocks the median filtering.

16. A hearing device, comprising:

a radio device to transmit signals to a second hearing device, the radio device comprising an antenna device to perform at least one of transmitting and receiving, the antenna device comprising a self-exciting oscillation circuit;

a receiver for receiving a plurality of values of at least one radio signal via a hearing device;

a median filter for median filtering of the plurality of values to produce a median value for a noise signal reduction; and an LC oscillation circuit that both generates a carrier frequency for transmission and clocks the median filtering.

17. A hearing device, comprising:

a receiving device configured to receive a plurality of values of at least one radio signal, the receiving device comprising a median filter device with which a median value of the plurality of values is determined for noise signal prevention; and a radio device with an antenna device comprising a self-exciting oscillation circuit comprising an LC oscillation circuit including a coil and a first capacitor, wherein the LC oscillation circuit is used both to generate a carrier frequency for transmission and to clock the receiving device;

the radio device further comprising:

a switch; and a second capacitor being connectable in parallel to the first capacitor by the switch, so that a resonance frequency of the self-exciting oscillation circuit can be modulated by switching the switch.

18. A method for noise signal reduction and hearing device receiving signals, comprising:

receiving a plurality of values representing frequencies of at least one radio signal via an antenna device of a hearing device, the antenna device comprising a self-exciting oscillation circuit; and median filtering of the plurality of values representing frequencies to produce a median value for a noise signal reduction by using the self-exciting oscillation circuit to clock the median filtering.

* * * * *